US006564927B2

(12) United States Patent
Meyer

(10) Patent No.: US 6,564,927 B2
(45) Date of Patent: May 20, 2003

(54) APPARATUS FOR CHARGING PACKAGING CONTAINERS WITH ITEMS

(75) Inventor: Peter Meyer, Beringen (CH)

(73) Assignee: SIG Pack Systems AG, Beringen (CH)

( * ) Notice: Subject to any disclaimer, the term of this patent is extended or adjusted under 35 U.S.C. 154(b) by 20 days.

(21) Appl. No.: 09/867,798

(22) Filed: May 31, 2001

(65) Prior Publication Data

US 2001/0047922 A1 Dec. 6, 2001

(30) Foreign Application Priority Data

Jun. 5, 2000 (CH) ..... 1109/00

(51) Int. Cl.[7] ..... B65G 47/04; B65G 47/19; B65G 47/44; B65G 47/24

(52) U.S. Cl. ..... 198/528; 198/435; 198/437; 198/529; 193/46

(58) Field of Search ..... 198/435, 436, 198/437, 528, 529, 531; 193/46; 53/171, 247, 249

(56) References Cited

U.S. PATENT DOCUMENTS

| | | | | |
|---|---|---|---|---|
| 3,512,336 A | | 5/1970 | Rosecrans | |
| 3,996,723 A | | 12/1976 | Greenwell | |
| 4,124,967 A | | 11/1978 | Beer et al. | |
| 4,265,072 A | | 5/1981 | Egli | |
| 4,938,003 A | * | 7/1990 | Seppala | 53/171 |
| 4,979,353 A | * | 12/1990 | Seppala | 53/171 |
| 5,813,196 A | * | 9/1998 | Page et al. | 53/171 |

FOREIGN PATENT DOCUMENTS

| | | |
|---|---|---|
| DE | 26 29 531 | 12/1979 |

* cited by examiner

*Primary Examiner*—Joseph E. Valenza
*Assistant Examiner*—Gene O Crawford
(74) *Attorney, Agent, or Firm*—Venable, LLP; Robert C. Kinberg; Chad C. Anderson

(57) ABSTRACT

An apparatus for charging containers includes a first conveyor for advancing items; a second conveyor for continuously advancing containers; a charging device including first and second chutes each having an inlet adjoining the discharge end of the first conveyor and an outlet positioned above the second conveyor. The first and second chutes adjoin one another in a direction parallel to the conveying direction of the second conveyor. A drive shifts the charging device and the discharge end of the first conveyor relative to one another for selectively aligning the inlet of the first chute or the inlet of the second chute with the discharge end for selectively introducing items from the first conveyor into the first or second chute. A sensor detects items advanced on the first conveyor. A control device is connected to the sensor and the drive for operating the drive based on the sensor signals.

14 Claims, 3 Drawing Sheets

APPARATUS FOR CHARGING PACKAGING CONTAINERS WITH ITEMS

CROSS REFERENCE TO RELATED APPLICATION

This application claims the priority of Swiss Application No. 2000 1109/00 filed Jun. 5, 2000, which is incorporated herein by reference.

BACKGROUND OF THE INVENTION

German Offenlegungsschrift (application published without examination) No. 26 29 531 describes a counting apparatus which includes a supply chute which has at its lower end a laterally displaceable counting device including two counting chutes. The counting chute which is in alignment with the supply chute is closed at the bottom by a stationary plate. As soon as the supply chute is full, the counting device is shifted so that the counting chute is emptied and the other counting chute is being filled. The counted products fall through a hopper into intermittently advanced packaging containers.

SUMMARY OF THE INVENTION

It is an object of the invention to provide an improved charging apparatus which operates reliably and with a high output rate.

This object and others to become apparent as the specification progresses, are accomplished by the invention, according to which, briefly stated, the apparatus for charging containers includes a first conveyor for advancing items; a second conveyor for continuously advancing containers; a charging device including first and second chutes each having an inlet adjoining the discharge end of the first conveyor and an outlet positioned above the second conveyor. The first and second chutes adjoin one another in a direction parallel to the conveying direction of the second conveyor. A drive shifts the charging device and the discharge end of the first conveyor relative to one another for selectively aligning the inlet of the first chute or the inlet of the second chute with the discharge end of the first conveyor for selectively introducing items from the first conveyor into the first or second chute. A sensor detects items advanced on the first conveyor. A control device is connected to the sensor and the drive for operating the drive based on the sensor signals.

DESCRIPTION OF THE PREFERRED EMBODIMENT

Figure 1:
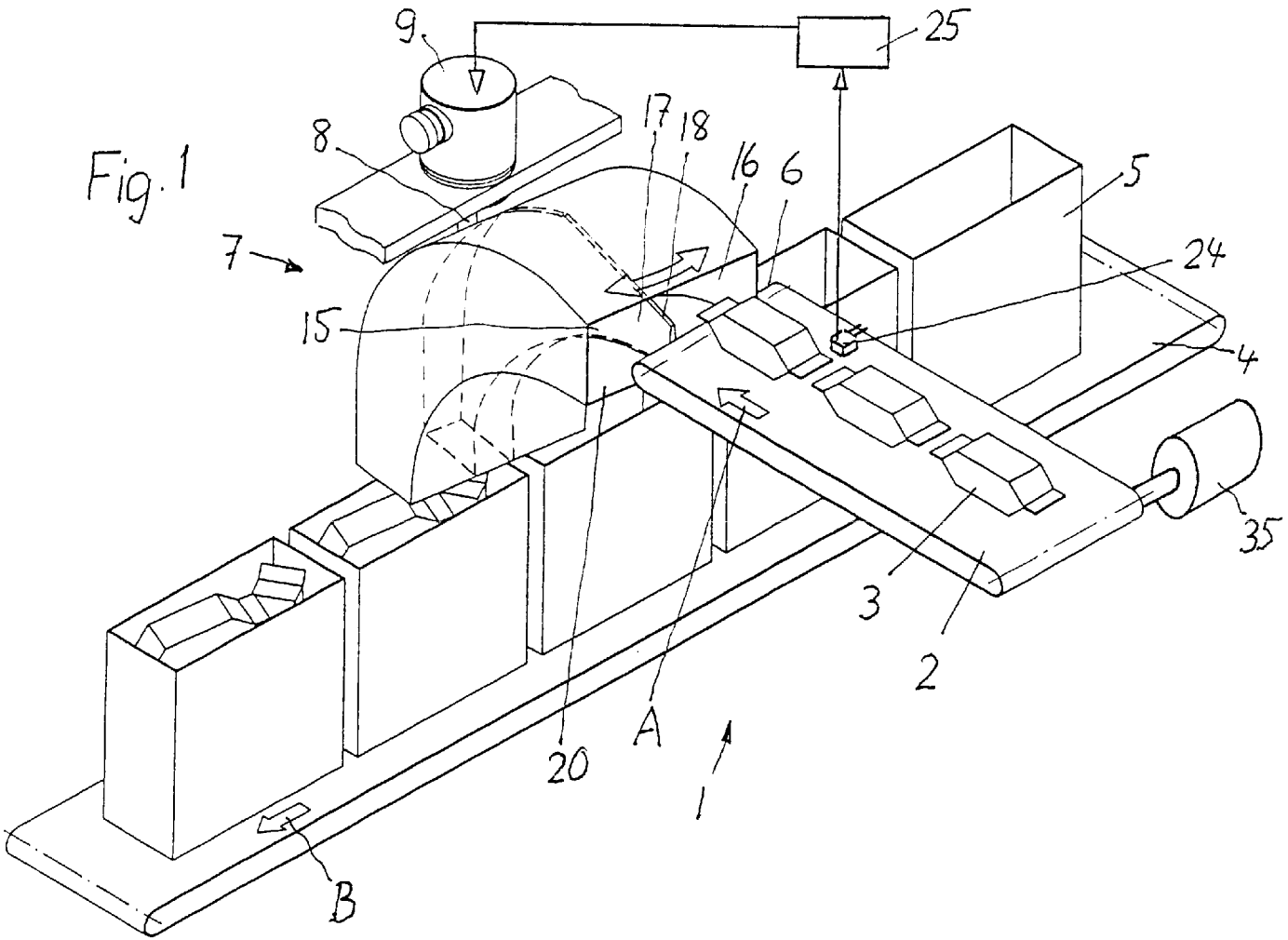
FIG. 1 is a schematic perspective view of a preferred embodiment according to the invention.

Turning to FIG. 1, the apparatus 1 shown therein includes a supply conveyor belt 2 continuously advancing items 3 (for example, a product or products in bag-like wrappers) in a column in a horizontal advancing direction A. A second conveyor belt 4 continuously advances uniformly spaced containers to be filled, such as boxes 5 in a column in a horizontal advancing direction B which is oriented perpendicularly to the advancing direction A.

A charging device 7 is arranged at the downstream (discharge) end 6 of the conveyor belt 2. The charging device 7 is coupled with a vertical shaft 8 which, in turn, is connected with the drive of an a.c. servomotor 9. The charging device 7 has two chutes 15, 16 which are adjoining one another in the advancing direction B and which are separated from one another by a septum 17. The septum 17 has at its upstream end (that is, at its end adjoining the discharge end 6 of the conveyor 2) an upper edge 18 which starts underneath the upper face of the conveyor belt 2 and which rises in the conveying direction A. Further, the septum 17 widens in a wedge-like manner in the conveying direction of the charging device 7 so that the chutes 15, 16 have at their outlet end 19 a significant distance from one another which is greater than the intermediate space between successive boxes 5. The chutes 15, 16 are bent from the discharge end of the conveyor belt 2 arcuately downwardly through 90°. Their common bottom wall 20 has the approximate configuration of a trajectory parabola.

An item sensor 24 is arranged at the discharge end 6 of the conveyor belt 2 for detecting items 3 as they pass by. The sensor 24 which may be, for example, an optical barrier, is coupled to a control device 25 which controls the servomotor 9. The servomotor 9 switches the position of the charging device 7 exclusively between two limit values. The inlet of the charging device 7 is displaced between the limit values at least to an extent which corresponds to the width of the items 3. The cross-sectional surface of the outlet opening 19 (FIGS. 2 and 3) of the chutes 15 and 16 in size and form corresponds approximately to the "footprint" of the boxes 5. The cross-sectional surfaces of the chutes 15, 16 correspond in their lengths and widths over the entire chute length at least to the length of the diagonals of the items 3 to prevent them from jamming in the chutes 15, 16. The axis of the shaft 8 passes approximately through the center of the plane of the outlet opening 19.

Figure 2:
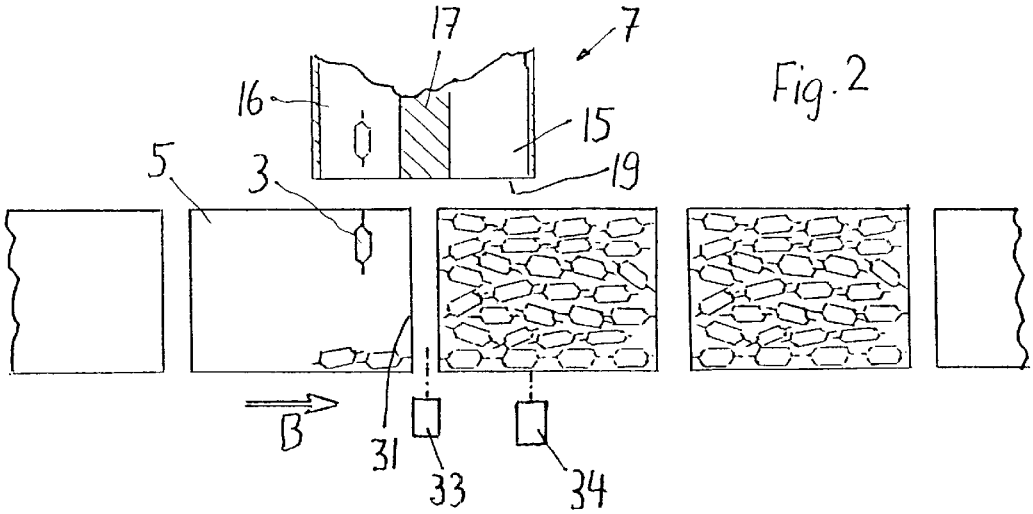
FIGS. 2 and 3 are schematic top plan views illustrating two different operational states of the preferred embodiment.
Figure 3:
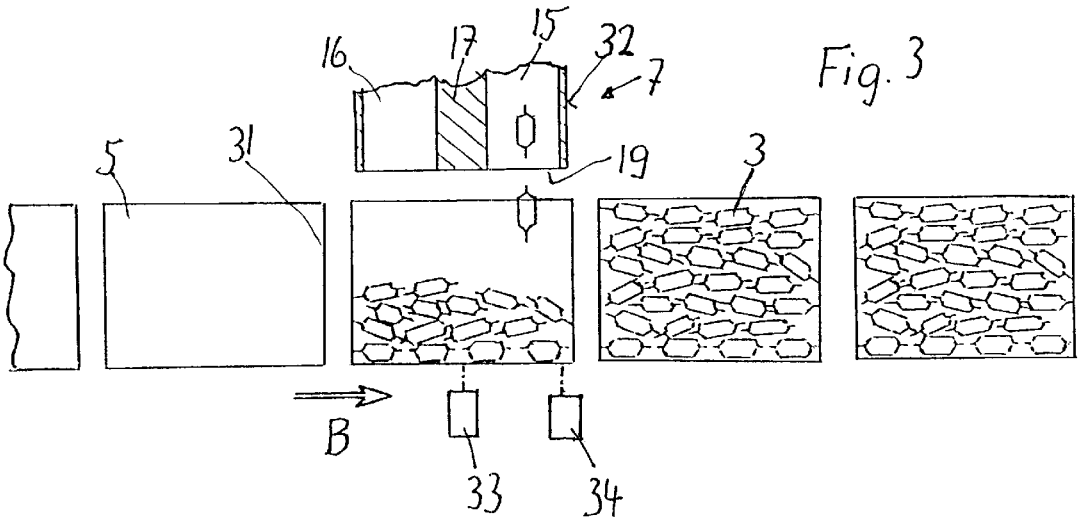

In the description which follows the operation of the above-described apparatus will be set forth in conjunction with the schematic FIGS. 2 and 3.

If, as viewed in the advancing direction B, the leading wall face 31 of a box 5 has reached approximately the middle of the outlet 19 of the two chutes 15 and 16 viewed together, that is, the wall face 31 is approximately centrally aligned with the space between the chutes 15 and 16, the charging device 7 is shifted such that the items 3 are, by the conveyor 2, delivered into the chute 16 situated upstream relative to the advancing direction B and drop into the newly presented box 5 (FIG. 2). Such a switchover occurs when a momentarily leading item 3 on the conveyor 2 has not yet reached the inlet end of the charging device 7.

The control device 25 includes a counter which counts the items as they pass by the sensor 24. When the box 5 which is in the process of being filled from the chute 16 has received one half of the intended item quantity, the leading wall 31 of the box 5 being filled has reached its position approximately as shown in FIG. 3. In that position the box wall 31 arrived at the downstream edge 32 of the charging device outlet 19, as viewed in the conveying direction B. At that moment the charging device 7 is switched over into its other end position and thus the chute 15 is charged with items until the counter in the control device 25 has reached the set limit value and the box 5 is fully charged with the desired number of items. At that moment the leading wall 31 of the successive box 5 has reached approximately the center of the space between the chutes 15 and 16, whereupon the motor 19 shifts the charging device 7 back into its first position so that the successive box 5 is being charged from the chute 16.

The above-described apparatus according to the invention provides for the charging of continuously conveyed boxes 5 with continuously supplied items 3 resulting in a very high output rate. Thus, in a prototype apparatus up to 1,000 items 3 per minute could be delivered to the packaging containers. The charging device 7 is insensitive to tolerances in the item supply. If switching does not occur at the exactly correct moment when an intermediate space between the items 3 has reached the inlet end of the apparatus 7, then the successive item 3 falls on the oblique edge 18 of the septum 17 and automatically tumbles into the respective chute 15 or 16 and thus the shift of the charging device 7 does not have to be completed. Because of the width of the downstream end of the septum 17 the items 3 are prevented from falling into the intermediate space between two boxes 5. The apparatus 1 is of simple structure and is operationally reliable to a high degree because of the continuous, rather than intermittent, operation.

In case the boxes 5 are to be delivered irregularly spaced, it may be expedient for an accurate control of the switching process, to provide one or two additional optical barriers 33, 34. The latter emit a signal to the control device 25 when the leading wall face 31 of a box 5 reaches a position underneath the septum 17 or, as the case may be, underneath the downstream end 32 of the outlet opening 19. In such a case, the counter controls the drive motor 35 of the conveyor belt 2 and arrests the latter when one-half or, as the case may be, a full number of items is reached in a respective box 5. The motor 35 is restarted only after the charging device 7 is switched. Such an arrangement lends substantial flexibility to the apparatus 1.

Figure 4:
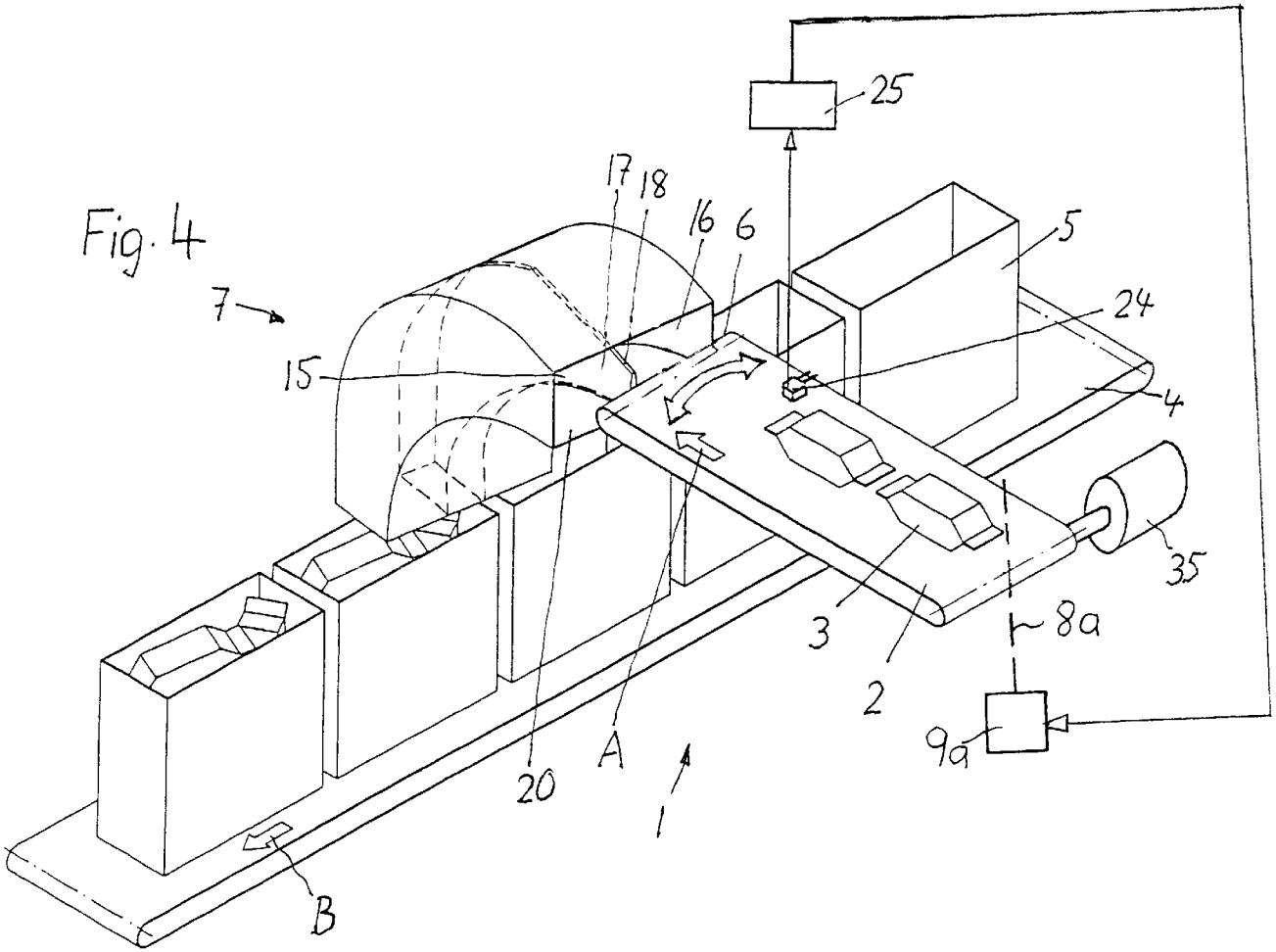
FIG. 4 is a schematic perspective view of a variant of the FIG. 1 construction.

It is to be understood to be within the scope of the invention to provide that instead of moving the charging device 7, it is the conveyor belt 2 which is moved transversely to the advancing direction A of the conveyor belt 2. Thus, as shown symbolically in FIG. 4, the conveyor belt 2 is supported on a vertical rotary shaft 8*a* which is coupled to a servomotor 9*a* such that the discharge end 6 of the conveyor 2 may be alternatingly pivoted into two positions, that is, into alignment with the inlet of the chute 15 or 16. The servomotor 9*a* is connected to the control device 25, similarly to the servomotor 9 of the FIG. 1 arrangement.

It will be understood that the above description of the present invention is susceptible to various modifications, changes and adaptations, and the same are intended to be comprehended within the meaning and range of equivalents of the appended claims.

What is claimed is:

1. An apparatus for charging packaging containers with items, comprising (a) a first conveyor for advancing items in a path of travel in a first conveying direction; said first conveyor having a discharge end;

(b) a second conveyor for continuously advancing packaging containers in a second conveying direction;

(c) a charging device including side-by-side disposed first and second chutes each having an inlet adjoining said discharge end of said first conveyor and an outlet positioned above said second conveyor and adapted to be aligned with packaging containers advanced on said second conveyor; said first and second chutes adjoining one another in a direction parallel to said second conveying direction; said chutes being downward arcuate in a vertical plane from the inlet to the outlet of said first and second chutes;

(d) drive means for moving said charging device and said discharge end of said first conveyor relative to one another transversely to said first conveying direction for selectively aligning the inlet of said first chute or the inlet of said second chute with said discharge end for selectively introducing items from said first conveyor into said first or second chute;

(e) a sensor for detecting items advanced on said first conveyor; and (f) a control device connected to said sensor and said drive means for operating said drive means based on signals emitted by said sensor.

2. The apparatus as defined in claim 1, wherein said drive means is operatively coupled to said charging device for moving said charging device relative to said discharge end of said first conveyor transversely to said first conveying direction.

3. The apparatus as defined in claim 1, wherein a spacing between the inlet of said first chute and the inlet of said second chute is less in said second conveying direction than a spacing between the outlet of said first chute and the outlet of said second chute.

4. The apparatus as defined in claim 1, wherein said first and second conveying directions are at least approximately horizontal and are at least approximately perpendicular to one another.

5. The apparatus as defined in claim 1, in combination with packaging containers advanced on said second conveyor; each packaging container having an opening of predetermined size and form; the outlet of said first chute and the outlet of said second chute having together a size and outline being at least approximately the same as said size and outline of said packaging containers.

6. The apparatus as defined in claim 1, in combination with the items handled thereby; any cross section of each of said first and second chute having a greatest length dimension being at least as large as a diagonal length of the items.

7. The apparatus as defined in claim 1, wherein said control device comprises a counter for adding signals emitted by said sensor.

8. The apparatus as defined in claim 1, wherein said sensor comprises an optical barrier.

9. The apparatus as defined in claim 1, wherein said first and second conveyors are conveyor belts.

10. An apparatus for charging packaging containers with items, comprising (a) a first conveyor for advancing items in a path of travel in a first conveying direction; said first conveyor having a discharge end;

(b) a second conveyor for continuously advancing packaging containers in a second conveying direction;

(c) a charging device including side-by-side disposed first and second chutes each having an inlet adjoining said discharge end of said first conveyor and an outlet positioned above said second conveyor and adapted to be aligned with packaging containers advanced on said second conveyor; said first and second chutes adjoining one another in a direction parallel to said second conveying direction;

(d) drive means for moving said charging device and said discharge end of said first conveyor relative to one another transversely to said first conveying direction for selectively aligning the inlet of said first chute or the inlet of said second chute with said discharge end for selectively introducing items from said first conveyor into said first or second chute;

(e) a sensor for detecting items advanced on said first conveyor;

(f) a control device connected to said sensor and said drive means for operating said drive means based on signals emitted by said sensor; and (g) a septum constituting a common separating wall of said first and second chutes; said septum having an upper edge starting at said discharge end at a level below said discharge end and subsequently rising in said first conveying direction.

11. The apparatus as defined in claim 10, wherein said septum, as viewed along said first and second chutes, widens in said second conveying direction, whereby a spacing between the inlet of said first chute and the inlet of said second chute is less in said second conveying direction than a spacing between the outlet of said first chute and the outlet of said second chute.

12. An apparatus for charging packaging containers with items, comprising (a) a first conveyor for advancing items in a path of travel in a first conveying direction; said first conveyor having a discharge end;

(b) a second conveyor for continuously advancing packaging containers in a second conveying direction;

(c) a charging device including side-by-side disposed first and second chutes each having an inlet adjoining said discharge end of said first conveyor and an outlet positioned above said second conveyor and adapted to be aligned with packaging containers advanced on said second conveyor; said first and second chutes adjoining one another in a direction parallel to said second conveying direction;

(d) drive means for moving said charging device and said discharge end of said first conveyor relative to one another transversely to said first conveying direction for selectively aligning the inlet of said first chute or the inlet of said second chute with said discharge end for selectively introducing items from said first conveyor into said first or second chute; said drive means being operatively coupled to said charging device for rotating said charging device about a vertical axis relative to said discharge end of said first conveyor transversely to said first conveying direction;

(e) a sensor for detecting items advanced on said first conveyor; and (f) a control device connected to said sensor and said drive means for operating said drive means based on signals emitted by said sensor.

13. An apparatus for charging packaging containers with items, comprising (a) a first conveyor for advancing items in a path of travel in a first conveying direction; said first conveyor having a discharge end;

(b) a second conveyor for continuously advancing packaging containers in a second conveying direction;

(c) a charging device including side-by-side disposed first and second chutes each having an inlet adjoining said discharge end of said first conveyor and an outlet positioned above said second conveyor and adapted to be aligned with packaging containers advanced on said second conveyor; said first and second chutes adjoining one another in a direction parallel to said second conveying direction;

(d) drive means for moving said charging device and said discharge end of said first conveyor relative to one another transversely to said first conveying direction for selectively aligning the inlet of said first chute or the inlet of said second chute with said discharge end for selectively introducing items from said first conveyor into said first or second chute; said drive means being operatively coupled to said first conveyor for moving said first conveyor relative to said charging device transversely to said first conveying direction;

(e) a sensor for detecting items advanced on said first conveyor; and (f) a control device connected to said sensor and said drive means for operating said drive means based on signals emitted by said sensor.

14. An apparatus for charging packaging containers with items, comprising (a) a first conveyor for advancing items in a path of travel in a first conveying direction; said first conveyor having a discharge end;

(b) a second conveyor for continuously advancing packaging containers in a second conveying direction;

(c) a charging device including side-by-side disposed first and second chutes each having an inlet adjoining said discharge end of said first conveyor and an outlet positioned above said second conveyor and adapted to be aligned with packaging containers advanced on said second conveyor; said first and second chutes adjoining one another in a direction parallel to said second conveying direction;

(d) drive means for moving said charging device and said discharge end of said first conveyor relative to one another transversely to said first conveying direction for selectively aligning the inlet of said first chute or the inlet of said second chute with said discharge end for selectively introducing items from said first conveyor into said first or second chute; said drive means being operatively coupled to said first conveyor for rotating said first conveyor about a vertical axis relative to said charging device transversely to said first conveying direction;

(e) a sensor for detecting items advanced on said first conveyor; and (f) a control device connected to said sensor and said drive means for operating said drive means based on signals emitted by said sensor.

* * * * *